United States Patent [19]

Matsuda

[11] Patent Number: 4,615,634

[45] Date of Patent: Oct. 7, 1986

[54] COATING ROLLER DEVICE WITH SCRAPER MEANS

[75] Inventor: Keiichiro Matsuda, Minoo, Japan

[73] Assignee: Kimura-Shin Co., Ltd., Osaka, Japan

[21] Appl. No.: 685,144

[22] Filed: Dec. 21, 1984

[30] Foreign Application Priority Data

Dec. 28, 1983 [JP] Japan ..... 58-249937

[51] Int. Cl.[4] ..... B05C 17/02

[52] U.S. Cl. ..... 401/197; 401/208

[58] Field of Search ..... 401/197, 208

[56] References Cited

U.S. PATENT DOCUMENTS

| | | | |
|---|---|---|---|
| 2,606,334 | 8/1952 | Vaden et al. | 401/197 |
| 2,849,157 | 8/1958 | Remien, Jr. | 401/197 X |
| 2,964,769 | 12/1960 | Mercereau | 401/197 X |
| 2,965,911 | 12/1960 | Hempel et al. | 401/197 |
| 3,539,268 | 11/1970 | Stebbins | 401/197 |

FOREIGN PATENT DOCUMENTS

| | | | |
|---|---|---|---|
| 493088 | 8/1976 | Australia | 401/197 |
| 540989 | 9/1955 | Belgium | 401/197 |
| 822859 | 9/1969 | Canada | 401/197 |
| 673698 | 3/1939 | Fed. Rep. of Germany | 401/197 |
| 1030227 | 5/1958 | Fed. Rep. of Germany | 401/197 |

*Primary Examiner*—Steven A. Bratlie

*Attorney, Agent, or Firm*—Joseph W. Farley

[57] ABSTRACT

A coating roller device which rotatably supports on a supporting shaft a tubular cylindrical coating roller body provided with delivery holes for a coating material through its circumferential wall, and which is adapted to feed a coating material to the roller body, incorporates within the roller body a scraper means extending substantially the whole length of the roller body, and having a scraping element fixed on the supporting shaft and approximating the inner circumferential surface of the roller body. The roller body is rotatable relatively to the scraper means. When the roller body is brought into contact with a surface and is moved therealong by using the supporting shaft, the roller body rotates relatively to the scraper means, whereby the coating material fed into the roller body is scraped off the inner surface thereof through the delivery holes in the circumferential wall of the roller body by the scraping element of the scraper means.

3 Claims, 12 Drawing Figures

COATING ROLLER DEVICE WITH SCRAPER MEANS

BACKGROUND OF THE INVENTION

The present invention relates to a coating roller device which is favorable for the application of a coating material of high viscosity, in which the coating material is fed under pressure.

Conventional coating roller devices in which coating materials are fed under pressure are arranged to have coating rollers rotatably supported on supplying pipes of small diameter for the coating materials, which pipes serve also as shafts for pivotally connecting the roller bodies, whereby the coating materials supplied through the supplying pipes are fed to the insides of the cylindrical cores of the roller bodies, namely, to the annular spacing between the supplying pipes for the coating materials and the cylindrical cores of the roller bodies, which cores are provided with the outflow holes for the coating materials, from delivery holes made through the circumferential walls of the supplying pipes for the coating materials, and the coating materials within this annular spacing flow to the outside circumferential surfaces of the roller bodies from the outflow holes of the cylindrical cores for the coating materials.

In such conventional coating roller devices in which coating materials are fed under pressure, a coating material of high viscosity is forced out of the outflow holes of the cylindrical cores of the roller bodies by means of the supplying pressure for the coating material after the annular spacing inside the cylinderical cores have been filled with the coating material. Therefore, it is necessary to sufficiently increase the supplying pressure for the coating material. Also, since the annular spacing of great volume remains filled with the coating material, there is a risk that a great amount of coating material stays and hardens within the roller body particularly when the coating material is of a type which sets as a result of the chemical reaction of, for example, two constituent liquids, or any other similar type. The post-treatment of the coating material which sets and stays in the roller body needs a great amount of labor and time. These are disadvantages of the conventional coating roller devices.

SUMMARY OF THE INVENTION

The present invention provides a coating roller device in which a coating material is fed under pressure to remove the foregoing disadvantages of the conventional coating roller devices.

The characteristic of the present invention is that a coating roller device which rotatably supports on a supporting shaft a coating roller body provided through its circumferential wall with delivery holes for a coating material, and which adapted to feed a coating material into the roller body, incorporates in the roller body a scraper means for the coating material having, over the substantially whole length of the roller body, a scraping element fixed on the supporting shaft so as to approximate the inner circumferential surface of the roller body, whereby the roller body is rotated relatively to the scraper means for the coating material.

According to the coating roller device of the present invention, even if a coating material fed into the roller body is so high in its viscosity that gravity does not allow the coating material to flow naturally out of the roller body, and moreover, even if the coating material is so small in its feeding amount that it can not fill the inside of the roller body, namely, the smallness in the feeding amount of the coating material is such that it only adheres to the inner circumferential surface of the roller body, the coating material which has adhered to the inner circumferential surface of the roller body is allowed to be forcibly scraped off to the outer circumferential surface of the roller body from the delivery holes of the roller body by means of the scraper means for the coating material which automatically has relative rotation to and within the roller body as a result of the rotation of the roller body, and subsequently, for example, a coating brush or the like on the outer circumferential surface of the roller body is soaked in the coating material which is scraped off to the outer circumferential surface of the roller body, thereby achieving the satisfactory coating operation of the coating roller device.

From the foregoing description, it will easily be understood that the coating roller device of the present invention prevents any stay of a great amount of coating material within the roller body, and achieves the complete exhaustion of the coating material fed into the roller body when the coating works are finished even if the inside of the roller body is filled with the coating material.

DETAILED DESCRIPTION OF THE INVENTION

First Embodiment

Figure 1:
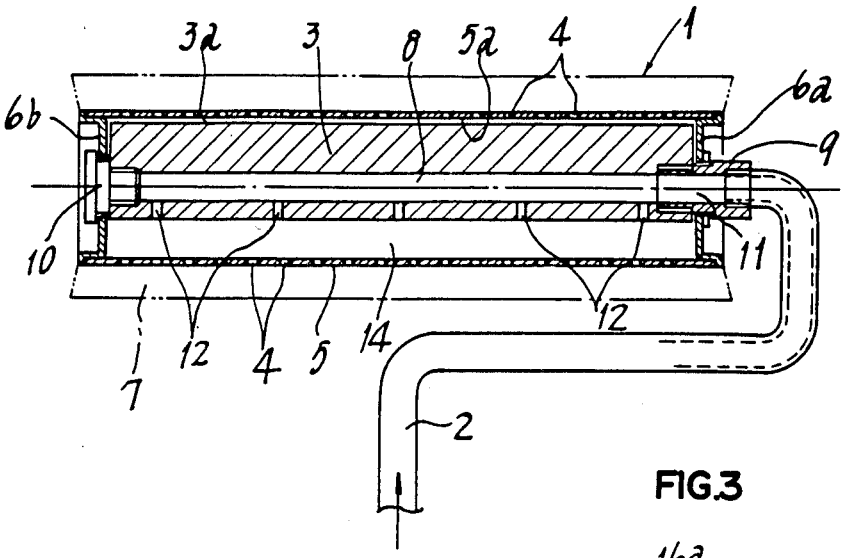
FIG. 1 is a longitudinal sectional elevational view showing a preferred embodiment of the present invention.
Figure 2:
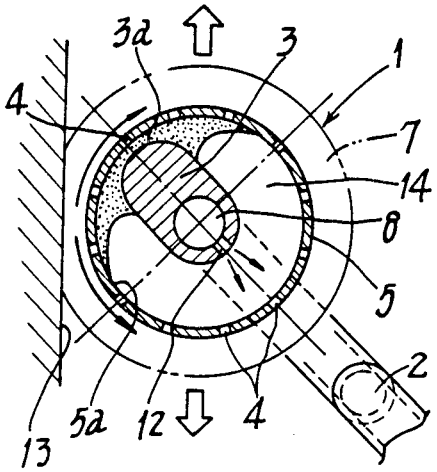
FIG. 2 is a cross sectional side view showing an operating condition of the coating roller device of the foregoing preferred embodiment of the present invention.

In FIGS. 1 and 2, 1 is a roller body, and 2 is a supporting shaft. 3 is a scraper means for a coating material. The roller body 1 comprises a cylindrical body 5 provided with a great number of delivery holes 4 for a coating material through its circumferential wall, with caps 6*a* and 6*b*, and also, with a cylindrical brush 7 fitted to the cylindrical body 5. The cylindrical brush 7 is made of a piled texture or the like, and is of a known type. This brush is shown by a broken line. The supporting shaft 2 is formed by means of a supplying pipe for a coating material. This supporting shaft is fitted with a grip and with a feeding hose for a coating material through a cock in its one end (not shown), and has the scraper means 3 connected to its other end.

The scraper means 3 for a coating material is furnished with a flow passage 8 for a coating material which extends longitudinally therethrough near one longituidinal side of said scraper means, and is provided with a sectionally arc-shaped scraping element 3*a* for a coating material over its whole length in its other side. The passage 8 for the flow of a coating material has a bearing member 9 thread-coupled to its one open end. This bearing member serves also as a connector for the supporing shaft, and one end of the roller body 1 is rotatably supported on this bearing member 9 through the cap 6*a*. The passage 8 for the flow of a coating material also has a bearing member 10 thread-coupled to its other open end. This bearing member 10 functions also as a blank cap of the cylindrical body 5, and the other end of the roller body 1 is rotatably carried on this bearing member 10 through the cap 6*b*.

The outside end portion of the bearing member 9 is thread-coupled to the end portion of the supporting shaft 2, and there is provided a passage 11 for the flow of a coating material which intercommunicatively connects the inside passage of the supporting shaft 2 and the passage 8 of the scraper means 3 for a coating material. Moreover, the scraper means 3 is provided with delivery holes 12 for a coating material at suitable intervals in the direction of the length of the passage 8 for the flow of a coating material, and the scraping element 3*a* approximates the diameter of the inner circumferential surface 5*a* of the cylindrical body 5 in the roller body.

In the coating roller device arranged as described in the foregoing, if a coating material is fed under predetermined pressure into the the supporting shaft 2 which serves also as a supply pipe for a coating material, the coating material passes through the passage 11 inside the bearing member 9, through the passage 8 within the scraper means 3, and flows into the spacing 14 inside the roller body 1 from the delivery holes 12. In this condition, if the roller body 1 is rotated, with the cylindrical brush 7 forced against a surface 13, the roller body 1 has relative rotation to the scraper means 3 for the coating material. For this reason, the coating material which has adhered to the inner circumferential surface 5*a* of the cylindrical body of the roller body is scraped together at the front side portion of the scraping element 3*a* of the scraper means 3, namely, at the rear of the rotating direction of the roller body 1, as illustrated in FIG. 2, and the coating mateial thus scraped together is forced out by means of the scraping element 3*a* into the cylindrical brush 7 from the wedge-shaped portion between the arc-shaped end surface of the scraping element 3*a* and the inner circumferential surface 5*a* of the cylindrical body 5 through the coating-material delivery holes 4 of the cylindrical body 5. If the roller body 1 is reversely rotated, the foregoing "scrape-off" operation is carried out at the rear of the rotating direction of the roller body 1 on the opposite side of the scraping element 3*a* for the coating material.

The coating material is thus forced out into the cylindrical brush 7, and this allows the cylindrical brush to be soaked in the coating material. The coating material is then transferred onto the surface 13, thereby achieving the coating of the surface.

Figure 3:
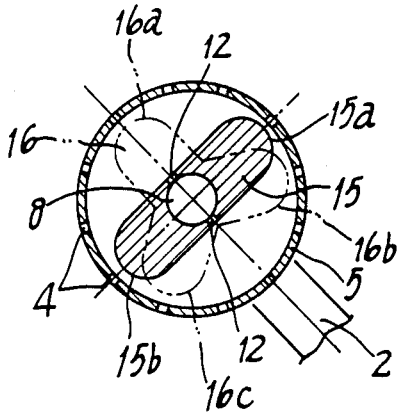
FIGS. 3 to 5 are cross sectional views respectively showing the principal portions of modifications of the scraper means for a coating material.
Figure 4:
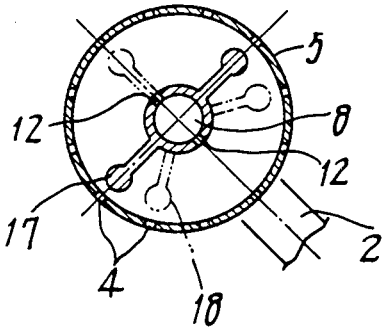

The scraper means 15 illustrated in FIG. 3 is furnished with scraping elements 15*a* and 15*b* at its both sides in the diametrical direction such that they approximate the inner circumferential surface 5*a* of the cylindrical body. Moreover, the scraper means 16 shown in an imaginary two-dot chain line is provided with three scraping elements 16*a* to 16*c* at regular intervals in the circumferential direction. From such embodiments of the scraping elements it will easily be understood that the scraping elements are not limited in number in the circumferential direction. Also, the delivery holes 12 for a coating material can be made between every two scraping elements. Moreover, as illustrated in the scraper means 17 or 18 of FIG. 4, it is desirable that the scraper means for a coating material is furnished with the minimum required thickness to achieve reduction in material cost and in weight.

Figure 5:
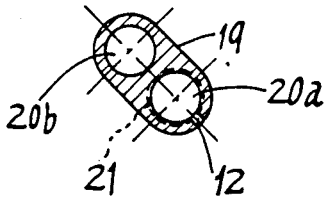
Figure 6:
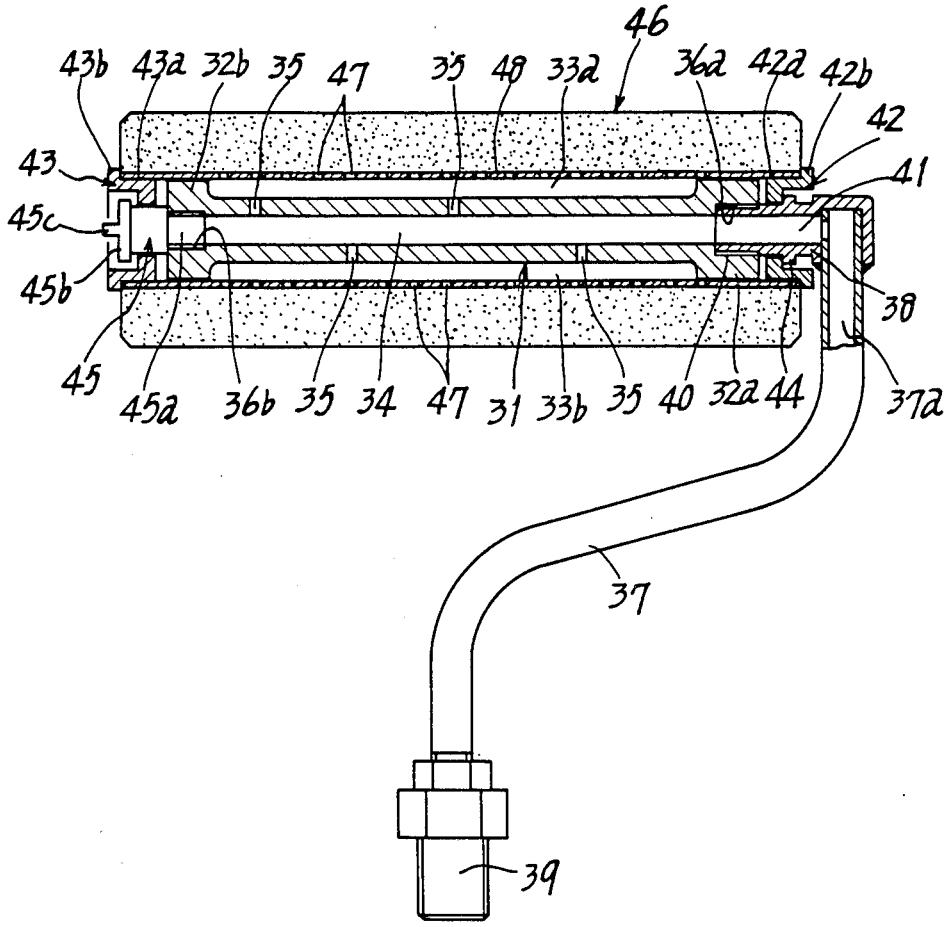
FIG. 6 is a longitudinal sectional elevational view showing a second preferred embodiment of the present invention.
Figure 7:
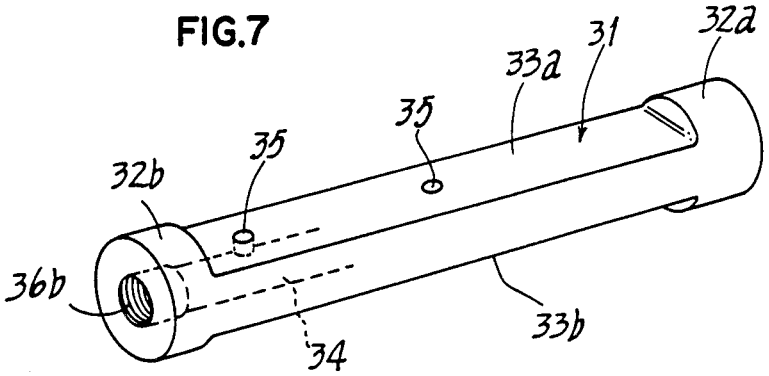
FIG. 7 is a perspective view of the scraper means of the second embodiment.
Figure 8:
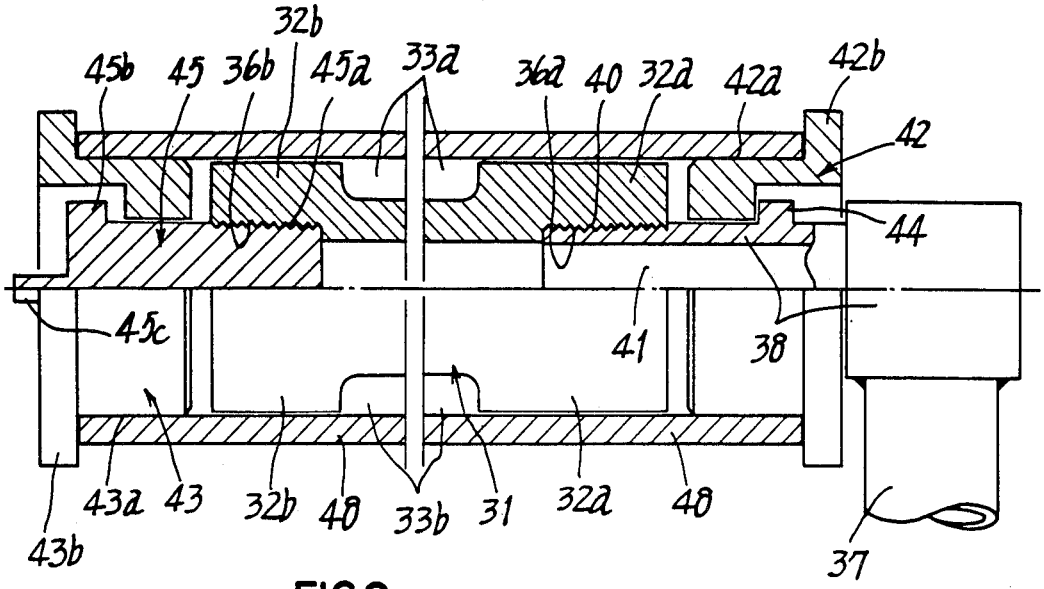
FIG. 8 is a longitudinal sectional enlarged elevational view showing the principal portion of the coating roller device of the second embodiment.
Figure 9:
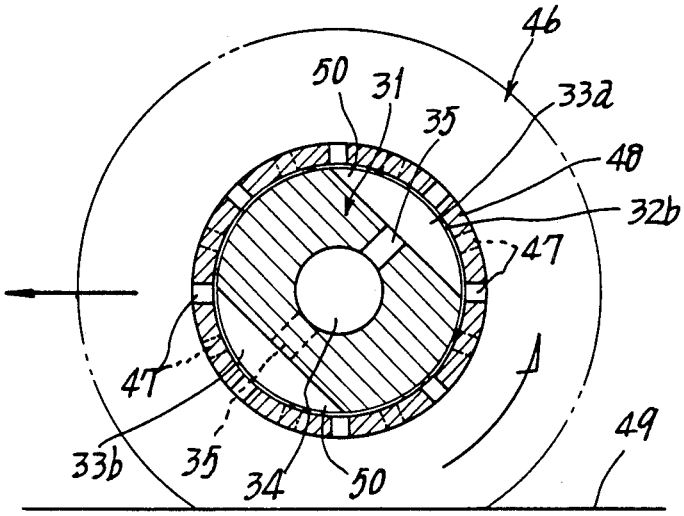
FIG. 9 is a longitudinal sectional side view showing the principal portion of the coating roller device in operation.

The scraper means 19 shown in FIG. 5 is formed with through-holes 20*a* and 20*b* of the same diameter over its whole length so as to be adjacent to its both longitudinal sides, and is arranged to be symmetrical in its sectional configuration including the shape of the outside surfaces of the both longitudinal sides. In this scraper means 19 for a coating material, either one of the two holes 20*a* and 20*b*, for example, the hole 20*a* may be provided with a thread 21 in its both ends to couple the foregoing bearing members 9 and 10 therewith, and may have coating-material delivery holes 12 machined therein which are intercommunicatively connected to said hole, while on the other hand, the hole 20*b* may be closed in its both ends by means of blank caps as the case may be. With such an arrangement, the scraper means 19 can be applied to greater economization and higher workability. That is to say, the hole 20*b* which is not used as a passage of the flow of a coating material is useful for material saving and weight reduction, and besides, when the thread and the delivery holes 12 for a coating material are machined, there is no necessity to select a predetermined one of both longitudinal sides, thereby improving the workability.

Second Embodiment

In FIGS. 6 to 9, 31 is a scraper means for a coating material, and in this scraper means, a circular tubular body is formed with depression portions 33*a* and 33*b* on both diametrical sides of the outer circumferential surface thereof, and with circular tubular portions 32*a* and 32*b* left intact on both ends thereof, while at the same time, the circular tubular body is provided with a plurality of axially spaced distributing passages 35 which intercommunicatively connect the notched depression portions 33*a* and 33*b* with a central supply passge 34 for a coating material, and the central supply passage 34 is concentrically formed with tapped hole portions 36*a* and 36*b* in its both ends. 37 is a supporting shaft which serves also as a supply pipe for a coating material, and a holding member 38 for the scraper means is horizontally connected at right angles with one end of this supporting shaft 37. The other end of the supporting shaft is provided with a handle connecting portion 39 which functions also as a supply pipe. The holding member 38 of the scraper means is formed with a threaded shaft portion 40 in its end, and when this threaded shaft portion 40 is coupled with the tapped hole portion 36*a* of one end of the scraper means 31 for a coating material, the scraper means is supported in the form of a cantilever. With this scraper means 31 thus supported, the holding member 38 of the scraper means is provided with a passage 41 which intercommunicatively connects the central supply passage 34 of the scraper means 31 and the internal passage 37*a* of the supporting shaft 37 which serves also as a supply pipe for a coating material.

42 and 43 are supporting caps for the roller body, and are provided with core supporting portions 42*a* and 43*a* of slightly larger diameter than the circular tubular portions 32*a* and 32*b* on both ends of the scraper means 31, and moreover, these supporting caps are furnished with flange portions 42*b* and 43*b* which are greater in diameter than the core supporting portions. One cap 42 is rotatably supported between the threaded portion 40 of the holding member 38 of the scraper means and a cap positioning flange 44 such that the flange portion 42*b* is located away from the threaded portion 40 of the holding member, and the other cap 43 rotatably rests upon a cap carrying shaft 45 which is coaxially connected to the tapped hole portion 36*b* on the outside end of the scraper means 31 through a threaded shaft portion 45*a*. 45*b* is a flange for the prevention of cap detachment, and 45*c* is a grip portion for rotating the cap.

46 is a roller body, and is provided with a cylindrical core 48 which is furnished with a great number of delivery holes 47 for a coating material. This cylindrical core is arranged to be slightly smaller in its inside diameter than the diameters of the core supporting portions 42*a* and 43*a* of the roller-body supporting caps 42 and 43.

In assembly, with the cap carrying shaft 45 and the cap 43 respectively unassembled, the roller body 46 is attached to the scraper means 31 from its one end side, and the inside end portion of the core 48 is closely fitted and fixed to the core supporting portion 42*a* by pressing the core 48 axially until the core 48 comes into contact with the the flange portion 42*b* of the cap 42. Next, the core supporting portion 43*a* of the cap 43 is axially pressed until the flange portion 43*b* comes into contact with the outside end of the core 48 to closely attach and fix the core supporting portion to the outside end portion of the core 48, and the threaded shaft portion 45*a* of the cap carrying shaft 45 is thread-coupled with the tapped hole portion 36*b* of the scraper means 31 through the central aperture of the cap 43, whereby the scraper means 31 for a coating material has the cap carrying shaft 45 connected to its outside end, and the cap carrying shaft 45 allows the cap 43 to be rotatably supported.

In operation, a coating material is fed under pressure to the central supply passage 34 of the scraper means 31 through the supporting shaft 37 which serves also as a supply pipe for a coating material. This coating material is forced out into the notched depression portions 33*a* and 33*b* from the inside of the supply passage 34 through the distributing passages 35. Under this condition, the roller body 46 is pressed against the surface 49, and is reciprocatively transferred along the coating surface 49 by using the supporting shaft 37 to rotate the roller body 46 about the scraper means 31 so that the roller body rolls on the surface.

The coating material fed into the notched depression portions 33*a* and 33*b* of the scraper means 31 is forced owing to friction between the coating material and the rotating core 48 against a corner portion 50 located in the rotating direction of the roller body, and this coating material is passed through the core 48 into the roller body 46 from each delivery hole 47 which passes the corner portion 50. The coating material thus introduced into the roller body 46 is transferred onto the coating surface 49 in accordance with the rolling operation of the roller body, and as a result, a coating film is formed on the coating surface 49.

In the foregoing second embodiment of the present invention, the notched depression portions 33*a* and 33*b* formed on the scraper means 31 are two in number. However, a single or more than three depression portions may be provided. Also, the depression portions may be concave on their bottom surfaces although they have flat bottom surfaces on the foregoing embodiment.

In the coating roller device of the second embodiment, the circular tubular portions 32*a* and 32*b* on both ends of the scraper means for a coating material approximate the inner circumferential surface of the core 48 of the roller body, and this allows the suppresion of any outward transfer of the coating material to each cap side from the portions. Therefore, it will easily be understood that leakage of a coating material from between the caps and the core of the roller body, between the caps and the shaft portions rotatably supporting the caps, or any other similar portions can be completely prevented or minimized.

Third Embodiment

Figure 11:
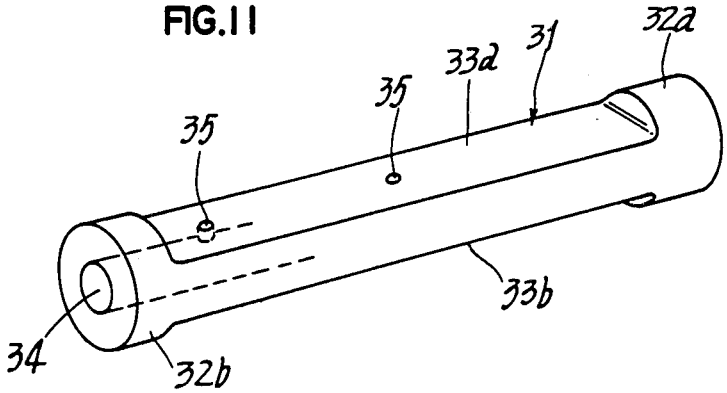
FIG. 11 is a perspective view of the scraper means of the third embodiment.
Figure 10:
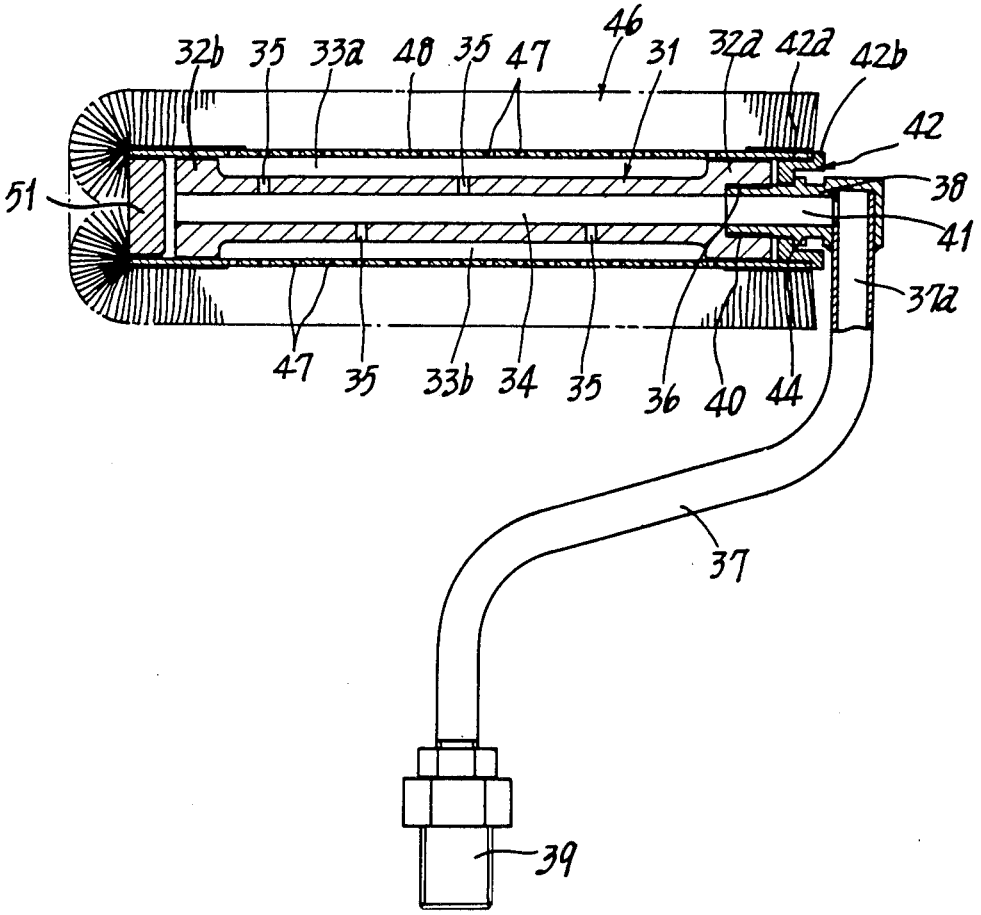
FIG. 10 is a longitudinal sectional view showing the third embodiment of the present invention.
Figure 12:
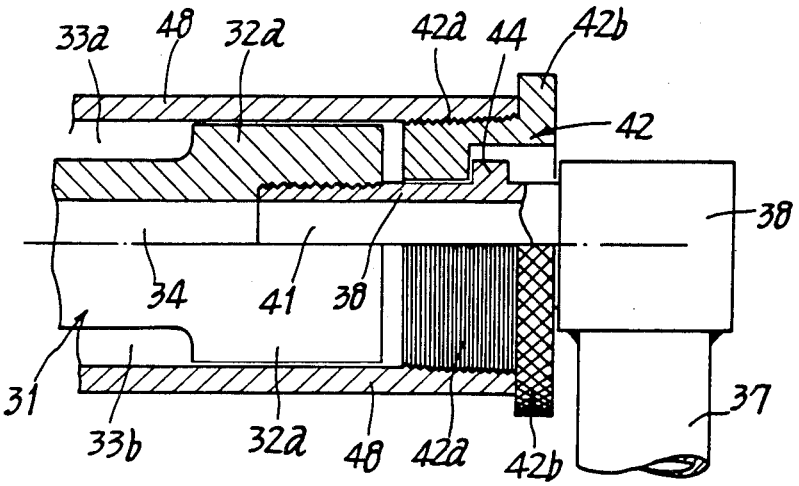
FIG. 12 is a longitudinal sectional englarged elevational view of the principal portion of the third embodiment.

The third embodiment shown in FIGS. 10 to 12 is a modification of the foregoing second embodiment, and in this third embodiment, the same reference numerals as in the second embodiment are given to the identical portions of the coating roller device with those of the second embodiment to omit their description. The differences of the third embodiment from the second embodiment are that a tapped hole portion 36 is only formed on a single end of the supply passage 34 which extends through the middle portion of the scraper means 31 for a coating material, that the core supporting portion 42*a* of the inside end supporting cap 42 for the roller body is threaded, that the outside end supporting cap 43 for the roller body and the cap carrying shaft 45 are removed, and that the roller body 46 is closed in its single end portion by means of the blank cap 51.

In assembly, the roller body 46 is attached to the scraper means 31 from its open end side, and both ends of the core 48 are rotatably supported on the circular tubular portions 32*a* and 32*b*, while at the same time, the core supporting portion 42*a* is coupled and fixed to the inside end portion of the core 48 in the reverse form of a reverse self-tapping screw by screwing the core 48 axially until the core 48 comes into contact with the the flange portion 42*b* of the cap 42 as shown in FIG. 12.

The operating manner described in the second embodiment applies to the coating roller device of this third embodiment.

The central supply passage 34 provided for a coating material in the scraper means 31 may be closed in the blank cap 51 side end portion of the roller body 46. Moreover, a method for coupling the supporting cap 42 for the roller body with the core 48 of the roller body 46 is not confined on the foregoing embodiment. For example, an alternative method is that small screws can be screwed or pins can be driven from the outside of the core 48 to fix the core and the supporting cap 42.

According to the arrangement of the third embodiment, a roller body closed at one end is employed and the core of this roller body is rotatably supported at its both ends on the circular tubular portions located on both end portions of the scraper means. Moreover, the rotatable cap is arranged to approximate one end of the scraper means so that the roller body is detachable from the scraper means. As a result of these arrangements, the component parts are extremely reduced in number, and this allows inexpensive manufacturing of the coating roller device of the third embodiment. Also, the cap side circular tubular portion of the scraper means approximates the diameter of the inner circumferential surface of the core of the roller body, thereby preventing the outward transfer of the coating material in the direction of the cap from the scraper means. For this reason, leakage of the coating material is completely obviated or minimized between the cap and the core of the roller body, between the cap and the shaft portion rotatably supporting the cap, or at any other similar portions.

What is claimed is:

1. A coating roller device comprising a support arm serving also as a supply pipe for a coating material; and elongate scraper having one end connected to one end of said support arm; a tubular coating roller body means rotatably fitted on said scraper, said roller body means having a cylindrical inner surface; and passage means provided in said scraper for guiding into the interior of said roller body means the coating material supplied through said support arm; wherein:

said scraper comprises a tubular member having cylindrical end portions, depressed portions formed in the sides of said scraper member between said end portions thereof, said depressed portions providing coating material receiving receptacles each having an arcuate radially outer side surface extending for the whole length thereof and positioned closely adjacent to the inner cylindrical surface of said roller body means;

said passage means includes a central axial supply passage in said scraper member and a plurality of distributing passages extending between said supply passage and each of said receptacles; and said cylindrical end portions of said scraper member each have an outer circumferential surface approximately the diameter of the inner cylindrical surface of said roller body means and adapted to restrict the flow of coating material from said receptacles axially toward the ends of said scraper member.

2. A coating roller device as defined in claim 1 further comprising a pair of bearing caps arranged and rotatably supported axially outwardly of said scraper member end portions, said bearing caps being fitted in both ends of said roller body means.

3. A coating roller device as defined in claim 1 wherein said roller body means has an open base end and a closed free end, the roller device further comprising a bearing cap removably fitted in said open end of said roller body means, said bearing cap being arranged and rotatably supported axially outwardly of one of said scraper member end portions positioned closer to said support arm, said closed end of said roller body means being rotatably supported on the other of said scraper member end portions.

* * * * *